US009423136B2

(12) United States Patent
Bellino et al.

(10) Patent No.: US 9,423,136 B2
(45) Date of Patent: Aug. 23, 2016

(54) BUNDLED TUBE FUEL INJECTOR AFT PLATE RETENTION

(71) Applicant: General Electric Company, Schenectady, NY (US)

(72) Inventors: Mark Carmine Bellino, Greenville, SC (US); James Christopher Monaghan, Moore, SC (US); Johnie F. McConnaughhay, Greenville, SC (US); Steven Charles Woods, Easley, SC (US); Gregory Scott Means, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 340 days.

(21) Appl. No.: 14/105,378

(22) Filed: Dec. 13, 2013

(65) Prior Publication Data

US 2015/0167984 A1 Jun. 18, 2015

(51) Int. Cl.
*F23R 3/28* (2006.01)
*F23R 3/60* (2006.01)

(52) U.S. Cl.
CPC ..... *F23R 3/286* (2013.01); *F23R 3/283* (2013.01); *F23R 3/60* (2013.01); *F23R 2900/00017* (2013.01)

(58) Field of Classification Search
CPC ..... F23R 3/283; F23R 3/286; F23R 3/60; F23R 3/343; F23R 2900/00017; F23R 2900/00018; F23R 2900/00019; F23D 14/62; F23D 14/64; F02M 61/14; F02C 7/20
USPC ..... 60/798, 737
See application file for complete search history.

(56) References Cited

U.S. PATENT DOCUMENTS

| | | | | |
|---|---|---|---|---|
| 3,105,026 | A | 9/1963 | Dickson | |
| 7,677,472 | B2 | 3/2010 | Hessler | |
| 7,941,923 | B2 | 5/2011 | Hessler | |
| 8,403,634 | B2 | 3/2013 | Arness et al. | |
| 2009/0188255 | A1* | 7/2009 | Green | F01D 9/023 60/737 |
| 2011/0100016 | A1* | 5/2011 | Cihlar | F02C 7/222 60/772 |
| 2012/0291451 | A1* | 11/2012 | Moehrle | F23R 3/60 60/796 |
| 2013/0122435 | A1* | 5/2013 | Stoia | F23R 3/286 431/12 |
| 2014/0033717 | A1* | 2/2014 | Pangle | F23R 3/60 60/722 |
| 2014/0116054 | A1* | 5/2014 | Means | F23R 3/283 60/739 |
| 2014/0338344 | A1* | 11/2014 | Stewart | F23R 3/10 60/747 |

* cited by examiner

*Primary Examiner* — Gerald L Sung
*Assistant Examiner* — Alain Chau
(74) *Attorney, Agent, or Firm* — Dority & Manning, PA

(57) ABSTRACT

A bundled tube fuel injector includes a fuel distribution module, a tube bundle having a plurality of pre-mix tubes that extend in parallel downstream from the fuel distribution module and a support plate disposed substantially adjacent to the fuel distribution manifold. The plurality of pre-mix tubes extends through the support plate. A retention sleeve is coupled to the support plate at a first end. A second end of the retention sleeve includes a plurality of radially extending retention features that are circumferentially arranged around the second end. The bundled tube fuel injector also includes an aft plate having a retention collar. The retention collar is configured to engage with the retention features. The retention sleeve and the retention collar partially define a cartridge passage that extends through the bundled tube fuel injector.

18 Claims, 7 Drawing Sheets

BUNDLED TUBE FUEL INJECTOR AFT PLATE RETENTION

FIELD OF THE INVENTION

The present invention generally involves a bundled tube fuel injector such as may be incorporated into a combustor of a gas turbine or other turbomachine. Specifically, the invention relates to the retention of an aft plate of the bundled tube fuel injector.

BACKGROUND OF THE INVENTION

Gas turbines are widely used in industrial and power generation operations. A typical gas turbine may include a compressor section, a combustion section disposed downstream from the compressor section, and a turbine section disposed downstream from the combustion section. A working fluid such as ambient air flows into the compressor section where it is progressively compressed before flowing into the combustion section. The compressed working fluid is mixed with a fuel and burned within one or more combustors of the combustion section to generate combustion gases having a high temperature, pressure, and velocity. The combustion gases flow from the combustors and expand through the turbine section to produce thrust and/or to rotate a shaft, thus producing work.

In a particular combustor design, the combustor includes one or more bundled tube fuel injectors that extend axially downstream from an end cover. The bundled tube fuel injector generally includes a fuel distribution module and a tube bundle having a plurality of pre-mix tubes that are in fluid communication with the fuel distribution manifold. The pre-mix tubes are arranged radially and circumferentially across the bundled tube fuel injector. The pre-mix tubes extend generally parallel to one another downstream from the fuel distribution manifold.

An outer shroud extends circumferentially around the pre-mix tubes downstream from the fuel distribution manifold. A support plate is disposed substantially adjacent to the fuel distribution manifold and the plurality of pre-mix tubes extends axially through the support plate towards an aft end of the bundled tube fuel injector. An aft plate or effusion plate extends radially and circumferentially across a downstream end of the outer shroud. A downstream or end portion of each pre-mix tube extends through the aft plate such that an outlet of each tube is downstream from a hot side surface of the aft plate, thus providing for fluid communication into the combustion chamber or zone.

In conventional bundled tube fuel injectors, the aft plate is connected to the bundled tube fuel injector by welding an outer perimeter of the aft plate to the downstream end of the outer shroud. In addition, a collar portion of the aft plate is welded or brazed to a cooling air flow sleeve that extends axially downstream from the support plate. The collar and the cooling air flow sleeve at least partially define a cartridge passage for inserting a fuel and/or air cartridge through the bundled tube fuel injector.

Although the weld joint formed at the collar and air flow sleeve joint is generally effective for retaining the aft plate to the bundled tube fuel injector, the weld joint is costly to manufacture due to various weld-prep operations required and may be generally difficult to weld due to a limited working area. In addition, removal of the aft plate for inspection, repair and/or replacement is time consuming and costly due to grinding, blending and/or other repair operations required to break the weld joint and prepare the parts for reassembly. Therefore, an improved bundled tube fuel injector would be useful.

BRIEF DESCRIPTION OF THE INVENTION

Aspects and advantages of the invention are set forth below in the following description, or may be obvious from the description, or may be learned through practice of the invention.

One embodiment of the present invention is a bundled tube fuel injector. The bundled tube fuel injector includes a fuel distribution module, a tube bundle having a plurality of pre-mix tubes that extend in parallel downstream from the fuel distribution module and a support plate disposed substantially adjacent to the fuel distribution module. The plurality of pre-mix tubes extends through the support plate. A retention sleeve is coupled to the support plate at a first end. A second end of the retention sleeve includes a plurality of radially extending retention features that are circumferentially arranged around the second end. The bundled tube fuel injector also includes an aft plate having a retention collar. The retention collar is configured to engage with the retention features. The retention sleeve and the retention collar partially define a cartridge passage that extends through the bundled tube fuel injector.

Another embodiment of the present disclosure is a bundled tube fuel injector. The bundled tube fuel injector includes a fuel distribution module, a fluid conduit that is in fluid communication with the fuel distribution module and a tube bundle having a plurality of pre-mix tubes that extend in parallel downstream from the fuel distribution module. The fluid conduit partially defines a cartridge passage through the fuel distribution module. The bundled tube fuel injector further includes a retention sleeve that is aligned with the inner sleeve and circumferentially surrounded by the pre-mix tubes. The retention sleeve includes a first end that is proximate to the fuel distribution module and a second end that is distal from the fuel distribution module. The second end includes a plurality of radially extending retention features. An aft plate having a retention collar is aligned with the retention sleeve and is configured to engage with the retention features.

Another embodiment of the present disclosure includes a gas turbine. The gas turbine includes a compressor, a combustor disposed downstream from the compressor and a turbine that is disposed downstream from the combustor. The combustor includes an end cover that is coupled to an outer casing and a bundled tube fuel injector that extends downstream from the end cover. The bundled tube fuel injector includes a fuel distribution module, a fluid conduit that is in fluid communication with the end cover and the fuel distribution module and a tube bundle having a plurality of pre-mix tubes that extend in parallel downstream from the fuel distribution module. The fluid conduit comprises an inner sleeve that at least partially defines a cartridge passage through the fuel distribution module. A retention sleeve is aligned with the inner sleeve and includes a first end that is proximate to the fuel distribution module. A second end of the retention sleeve is distal from the fuel distribution module. The second end includes a plurality of radially extending retention features. An aft plate extends radially and circumferentially across an end portion of the bundled tube fuel injector. The aft plate includes a retention collar that is aligned with the retention sleeve and configured to engage with the retention features.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
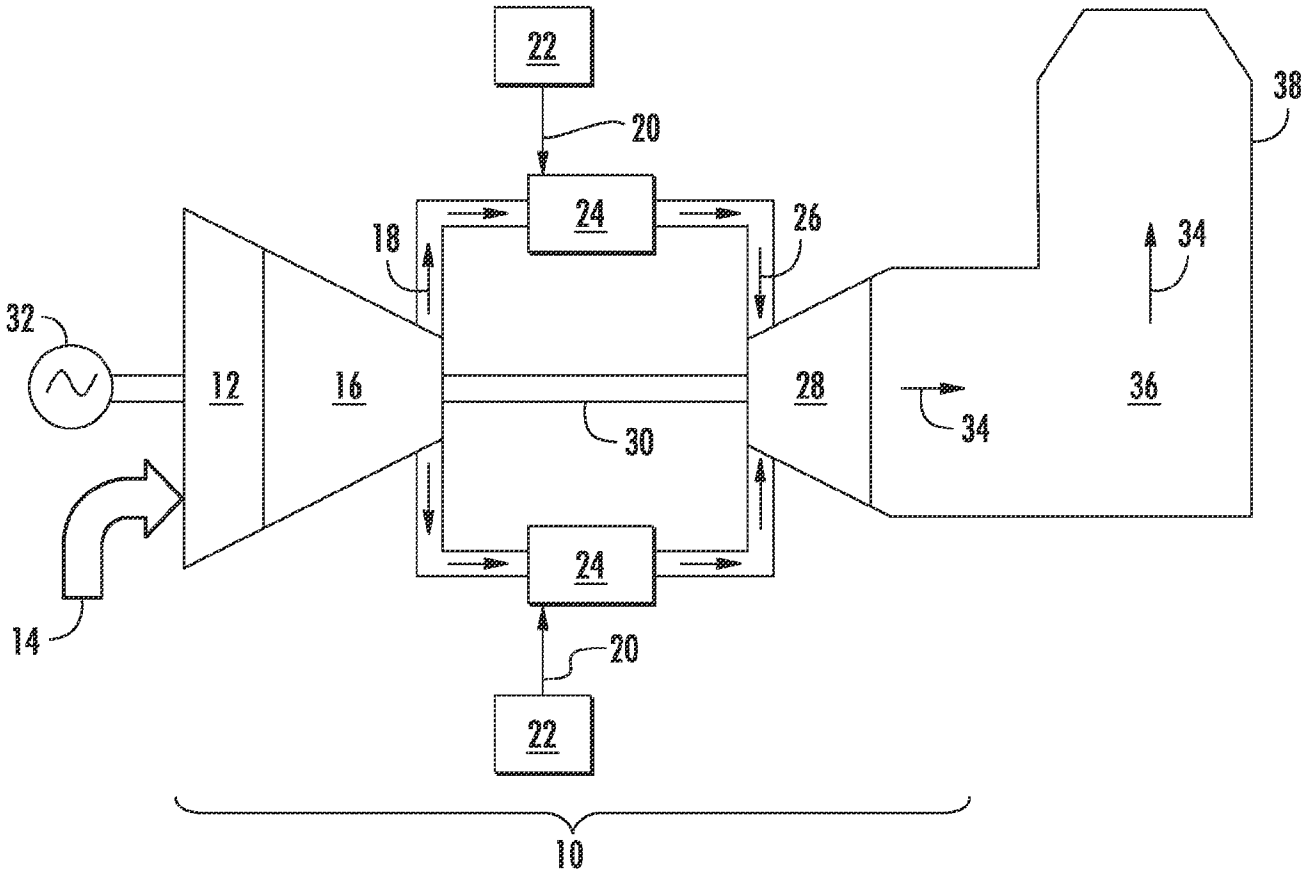
FIG. 1 PRIOR ART
FIG. 1 is a functional block diagram of an exemplary gas turbine that may incorporate various embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel to an axial centerline of a particular component.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Although exemplary embodiments of the present invention will be described generally in the context of a bundled tube fuel injector incorporated into a combustor of a gas turbine for purposes of illustration, one of ordinary skill in the art will readily appreciate that embodiments of the present invention may be applied to any combustor incorporated into any turbomachine and are not limited to a gas turbine combustor unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic energy to the working fluid 14 to produce a compressed working fluid 18.

The compressed working fluid 18 is mixed with a fuel 20 from a fuel source 22 such as a fuel skid to form a combustible mixture within one or more combustors 24. The combustible mixture is burned to produce combustion gases 26 having a high temperature, pressure and velocity. The combustion gases 26 flow through a turbine 28 of a turbine section to produce work. For example, the turbine 28 may be connected to a shaft 30 so that rotation of the turbine 28 drives the compressor 16 to produce the compressed working fluid 18. Alternately or in addition, the shaft 30 may connect the turbine 28 to a generator 32 for producing electricity. Exhaust gases 34 from the turbine 28 flow through an exhaust section 36 that connects the turbine 28 to an exhaust stack 38 downstream from the turbine 28. The exhaust section 36 may include, for example, a heat recovery steam generator (not shown) for cleaning and extracting additional heat from the exhaust gases 34 prior to release to the environment.

Figure 2:
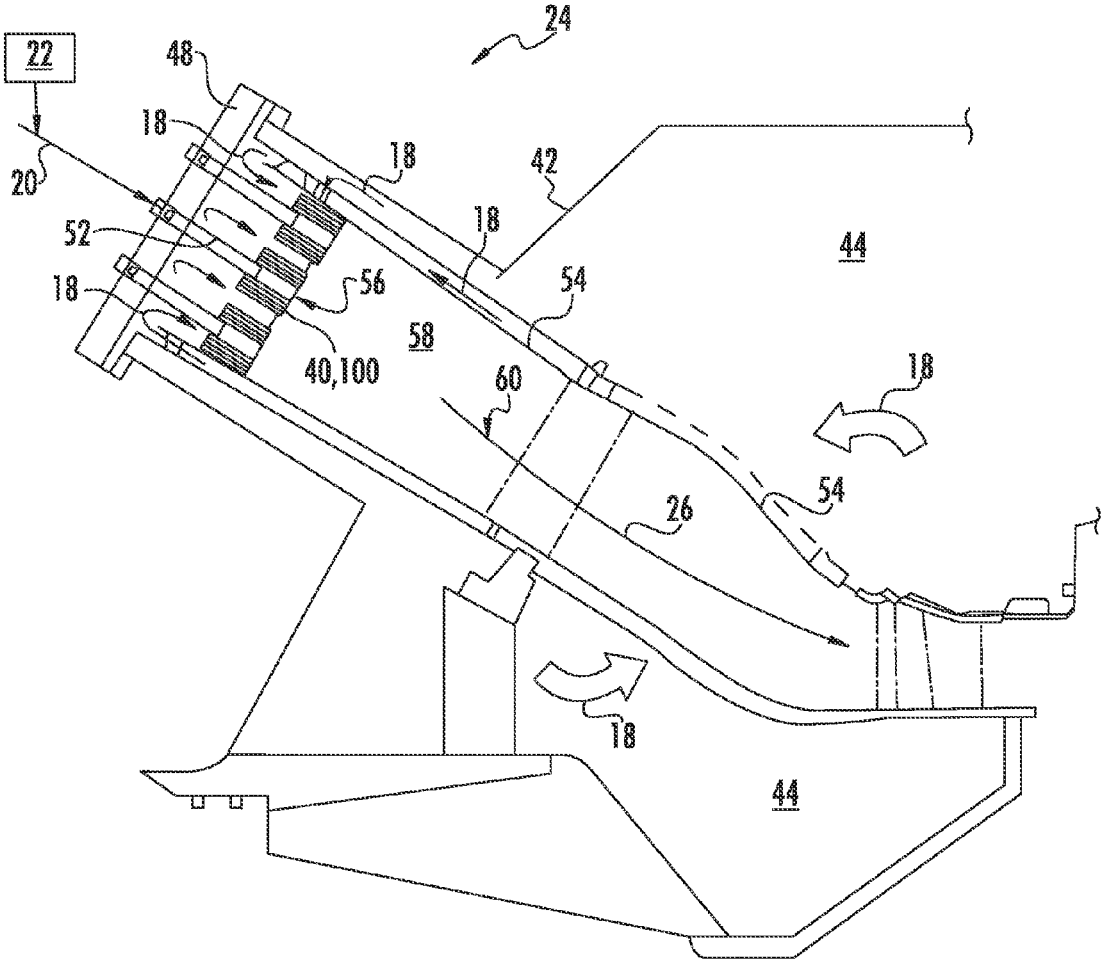
FIG. 2 is a simplified cross-section side view of an exemplary combustor as may incorporate various embodiments of the present invention.

FIG. 2 provides a simplified cross section of an exemplary combustor 24 as may incorporate a bundled tube fuel injector 40 configured according to at least one embodiment of the present disclosure. As shown, the combustor 24 is at least partially surrounded by an outer casing 42. The outer casing 42 at least partially forms a high pressure plenum 44 around the combustor 24. The high pressure plenum 44 may be in fluid communication with the compressor 16 or other source for supplying the compressed working fluid 18 to the combustor 24. In one configuration, an end cover 48 is coupled to the outer casing 42. The end cover 48 may be in fluid communication with the fuel supply 22.

As shown in FIG. 2, the bundled tube fuel injector 40 extends downstream from the end cover 48. The bundled tube fuel injector 40 may be fluidly connected to the end cover 48 so as to receive fuel from the fuel supply 22. For example, a fluid conduit 52 may provide for fluid communication between the end cover 48 and/or the fuel supply 22 and the bundled tube fuel injector 40. One end of an annular liner 54 such as a combustion liner and/or a transition duct surrounds a downstream end 56 of the bundled tube fuel injector 40 so as to at least partially define a combustion chamber 58 within the combustor 24. The liner 54 at least partially defines a hot gas path 60 for directing the combustion gases 26 from the combustion chamber 58 through the combustor 24. For example, the hot gas path 60 may be configured to route the combustion gases 26 towards the turbine 28 and/or the exhaust section.

In operation, the compressed working fluid 18 is routed towards the end cover 48 where it reverses direction and flows through one or more of the bundled tube fuel injectors 40. The fuel 20 is provided to the bundled tube fuel injector 40 and the fuel 20 and the compressed working fluid 18 are premixed or combined within the bundled tube fuel injector 40 before being injected into a combustion chamber 58 for combustion.

Figure 3:
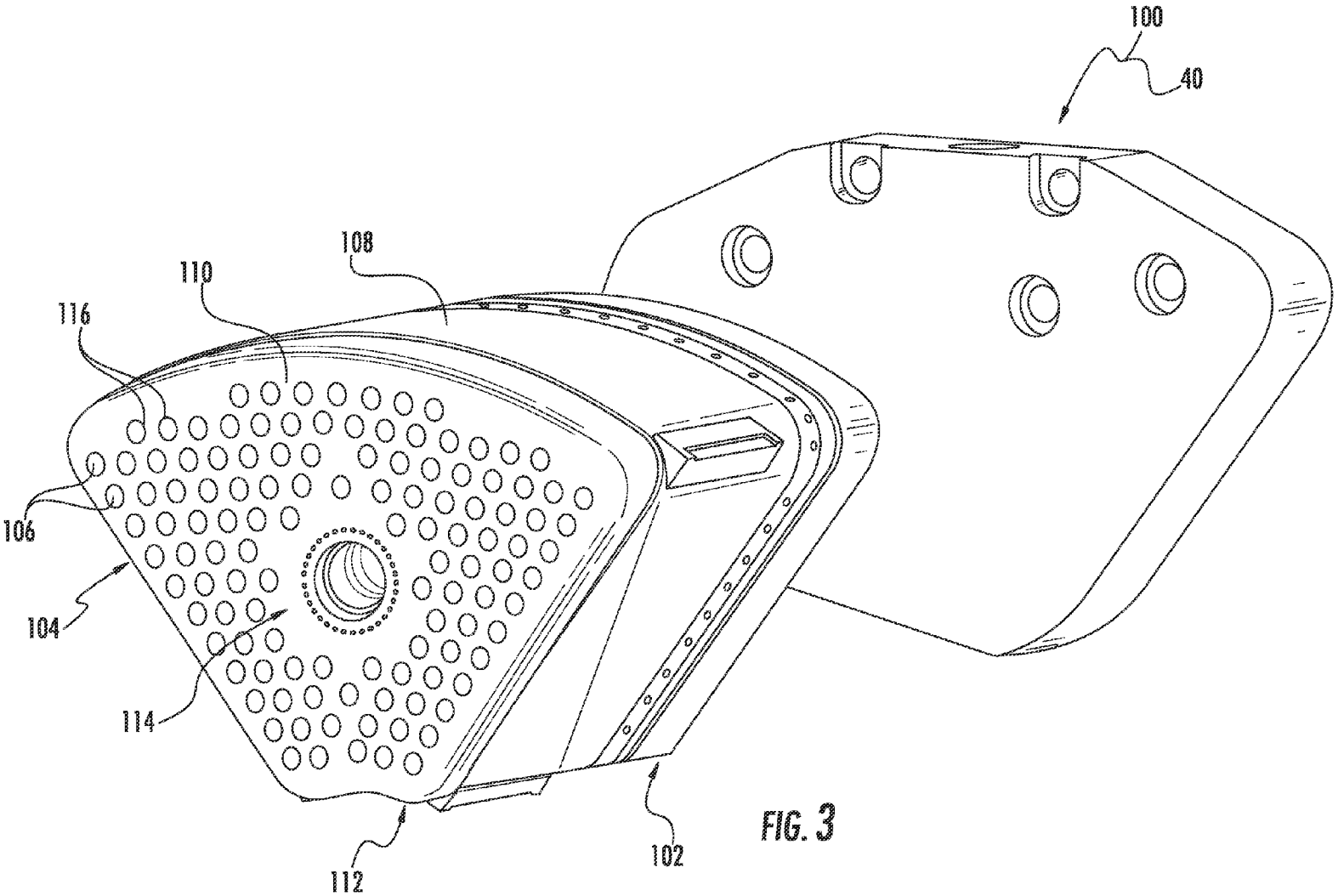
FIG. 3 is a cross section perspective view of an exemplary bundled tube fuel injector as may incorporate at least one embodiment of the present invention.
Figure 4:
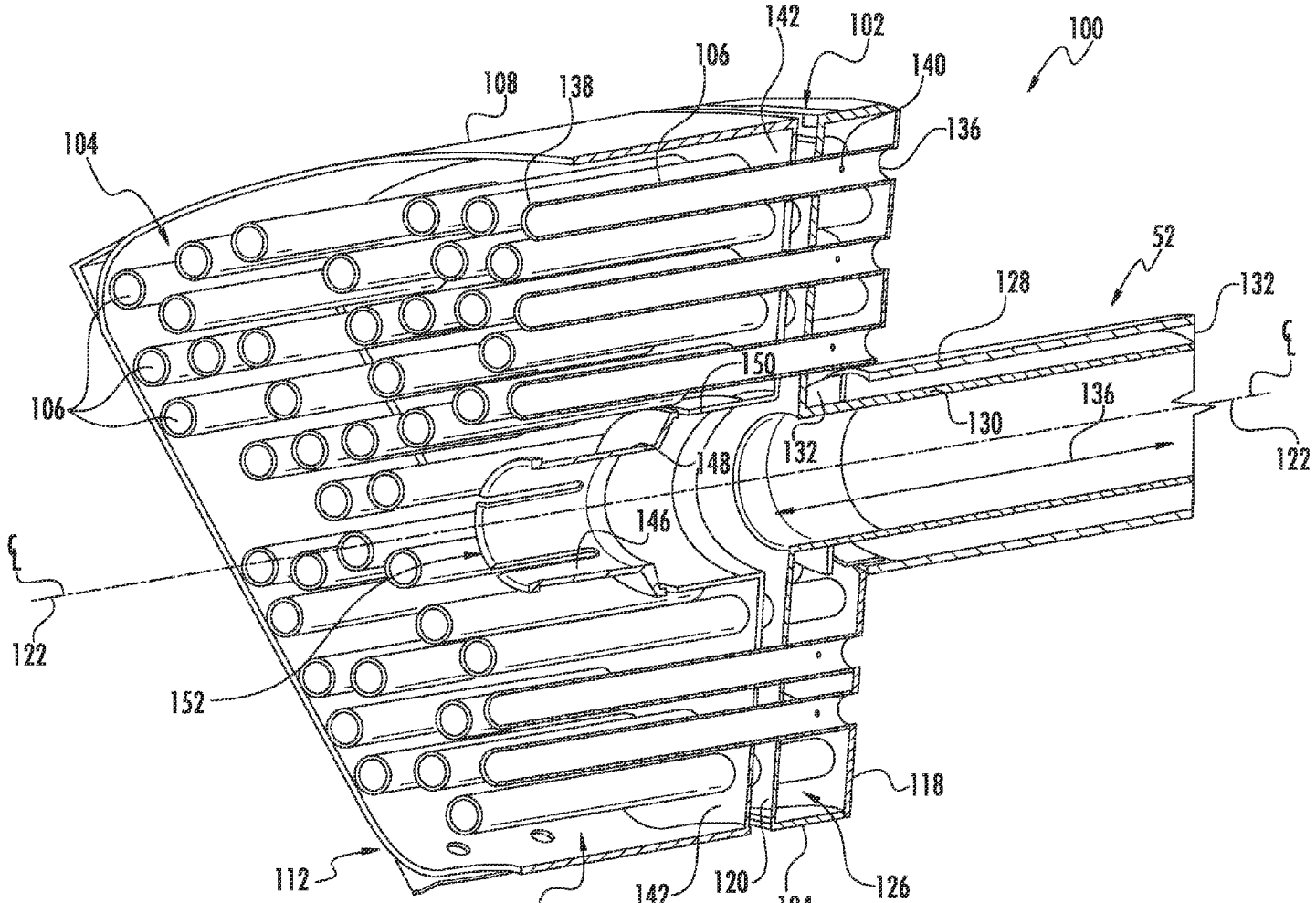
FIG. 4 is an enlarged cross sectional perspective view of a portion of the fuel injector as shown in FIG. 3, according to various embodiments of the present disclosure.

FIG. 3 is a perspective view of an exemplary bundled tube fuel injector 100 herein referred to as "fuel injector" as may be incorporated into the combustor 24 as described in FIG. 2, according to various embodiments of the present disclosure. FIG. 4 is an enlarged cross sectional perspective view of a portion of the fuel injector 100 as shown in FIG. 3, according to various embodiments of the present disclosure. In one embodiment, as shown in FIGS. 3 and 4, the fuel injector 100 includes a fuel distribution module 102, a tube bundle 104 including a plurality of pre-mix tubes 106 arranged radially and circumferentially across the fuel injector 100 and an outer shroud 108 that extends circumferentially around the tube bundle 104 axially away from the fuel distribution module 102.

In various embodiments, as shown in FIG. 3, an aft or effusion plate 110 extends radially and circumferentially across a downstream or end portion 112 of the fuel injector 100. The aft plate 110 may include a plurality of cooling holes 114 to allow cooling or purge air to pass therethrough, thereby providing at least one of film, convective or conductive cooling to the aft plate 110. A plurality of pre-mix tube passages 116 are defined by the aft plate 110. A downstream or end portion of each pre-mix tube 106 extends axially through the aft plate 110, thereby providing for fluid communication between the pre-mix tubes 106 and the combustion chamber 58.

In one embodiment, as shown in FIG. 4, the fuel distribution module 102 is at least partially defined by a first plate 118 and a second plate 120. The first and second plates 118, 120 extend radially and circumferentially across the fuel injector 100 with respect to an axial centerline 122 of the fuel injector 100. The second plate 120 is axially separated from the first plate 118 with respect to the axial centerline 122 of the fuel injector 100, In one embodiment, an outer band 124 extends circumferentially around and between the first and second plates 118, 120. The fuel distribution module 102 further includes a fuel plenum 126. In one embodiment, the fuel plenum 126 is at least partially defined by the first plate 118, the second plate 120 and the outer band 124.

In particular embodiments, the fluid conduit 52 provides for fluid communication between the fuel supply 22 (FIG. 2) and the fuel distribution module 102. For example, in one embodiment, the fluid conduit 52 provides for fluid communication between the fuel supply 22 and the fuel plenum 126. In one embodiment, as shown in FIG. 4, the fluid conduit 52 comprises an outer sleeve 128 that is radially separated from an inner sleeve 130 and a fuel passage 132 that is defined therebetween. The fuel passage 132 provides for fluid communication between the fuel supply 22 and the fuel plenum 126. In one embodiment, the inner sleeve 130 at least partially defines a cartridge passage 134 that extends axially through the fuel distribution module 102 with respect to the axial centerline 122.

As shown in FIG. 4, the pre-mix tubes 106 extend generally parallel to one another coaxially with or parallel to the axial centerline 122 of the fuel injector 100. The pre-mix tubes 106 extend downstream from the fuel plenum 126 towards the aft plate 110 (FIG. 3). The pre-mix tubes 106 may be formed from a single continuous tube or may be formed from two or more coaxially aligned tubes fixedly joined together. Although generally illustrated as cylindrical, the pre-mix tubes 106 may be any geometric shape, and the present invention is not limited to any particular cross-section unless specifically recited in the claims. In addition, the pre-mix tubes 106 may be grouped or arranged in circular, triangular, square, or other geometric shapes, and may be arranged in various numbers and geometries.

An exemplary pre-mix tube 106, as shown in FIG. 4, generally includes an inlet 136 defined upstream from the fuel plenum 126 and/or the first plate 118. The inlet 136 may be in fluid communication with the high pressure plenum 44 (FIG. 2) and/or the compressor 16 (FIG. 1). A downstream or end portion 138 is defined downstream from the fuel plenum 126. One or more fuel ports 140 may provide for fluid communication between the fuel plenum 126 and a corresponding pre-mix tube 106.

In operation, the compressed working fluid 18 is routed through the inlet 136 of each pre-mix tube 106 upstream from the fuel distribution module 102. Fuel is supplied to the fuel plenum 126 through the fluid conduit 52 and the fuel is injected into the pre-mix tubes 106 through the fuel ports 140. The fuel and compressed working fluid 18 mix inside the pre-mix tubes 106 before flowing out of the end portion 138 and into the combustion chamber or zone 58 for combustion.

In particular embodiments, the fuel injector 100 includes a support plate 142. In one embodiment, the support plate 142 extends radially and circumferentially across the fuel injector 100 with respect to the axial centerline 122. The support plate 142 is disposed substantially parallel and/or substantially adjacent to the fuel distribution module 102. The pre-mix tubes 106 extend axially through the support plate 142. The support plate 142 may provide radial support for the pre-mix tubes 106 and/or may align the pre-mix tubes with the aft plate 110. In one embodiment, the outer shroud 108, the aft plate 110 and the support plate 142 define a cooling or purge air plenum 144 that surrounds a portion of the tube bundle 104.

Figure 5:
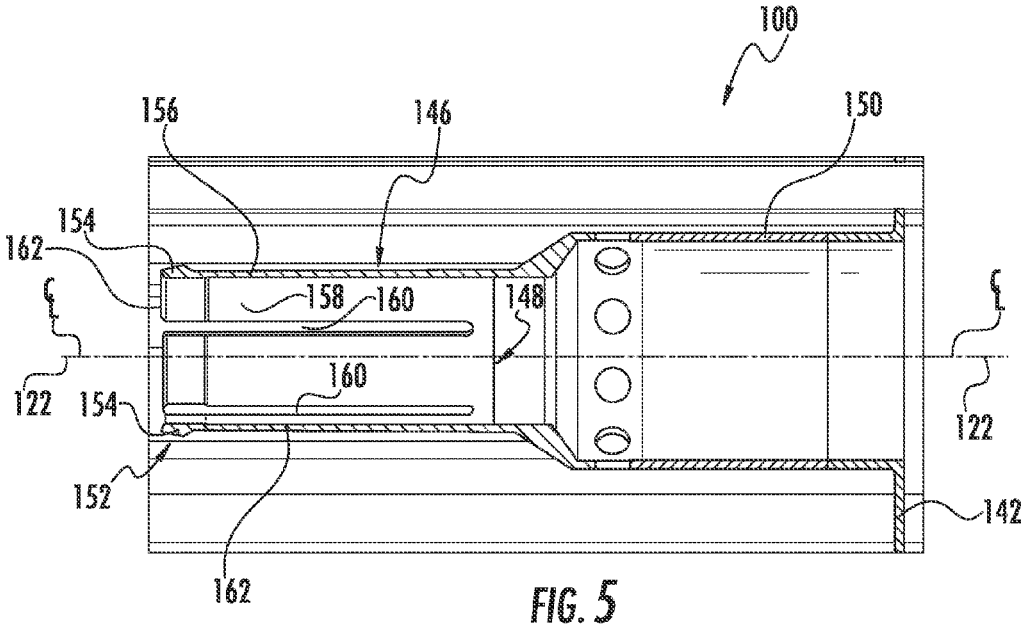
FIG. 5 is an enlarge cross section side view of an exemplary retention sleeve as shown in FIG. 4, according to one embodiment of the present invention.

In particular embodiments, the fuel injector 100 includes a retention sleeve 146. FIG. 5 provides an enlarge cross section side view of an exemplary retention sleeve 146 as shown in FIG. 4, according to one embodiment of the present invention. In one embodiment, the retention sleeve 146 is coupled to the support plate 142 at a first end 148. The first end is disposed generally proximate to the fuel distribution module 102, particularly the second plate 120. In one embodiment, the first end 148 may be coupled directly to the support plate 142. In one embodiment, the retention sleeve 146 is coupled to the support plate 142 via an air sleeve 150. The air sleeve 150 may be coaxially aligned with the retention sleeve 146, In one embodiment, the retention sleeve 146 and/or the air sleeve 150 at least partially define the cartridge passage 134. For example, as shown in FIG. 4, the air sleeve 150 and the retention sleeve 146 may be substantially coaxially aligned with the fluid conduit 52. In an alternate embodiment, the air sleeve 150 and/or the retention sleeve 146 may be coupled to the fuel distribution module 102.

In one embodiment, as shown in FIGS. 4 and 5, the retention sleeve 146 comprises a second end 152 having a profile which defines a plurality of retention features 154. The retention features 154 are circumferentially arranged around the second end 152 and extend generally radially outwardly. In one embodiment, the retention features 154 are at least partially defined by the retention sleeve 146. In one embodiment, a portion of each retention feature 154 extends radially outwardly with respect to an outer surface 156 of the retention sleeve. In one embodiment, a portion of each retention feature 154 extends radially inwardly with respect to an inner surface 158 of the retention sleeve.

In one embodiment, the retention sleeve 146 is slotted 160 from the second end 152 towards the first end 148 in the axial direction to allow for radial movement of the retention features 154 with respect to centerline 122. In particular embodiments, the slots 160 define spring arms or members 162 of the retention sleeve 146. In one embodiment, the retention sleeve 146 is tapered radially outwardly along the axial centerline 122 from the first end 148 towards the second end 152. In this manner, the slots 160 provide a radially outward spring or retention force to the retention features 154. In one embodiment, the retention sleeve is tapered radially inwardly along the axial centerline 122 from the first end 148 towards the second end 152.

Figure 6:
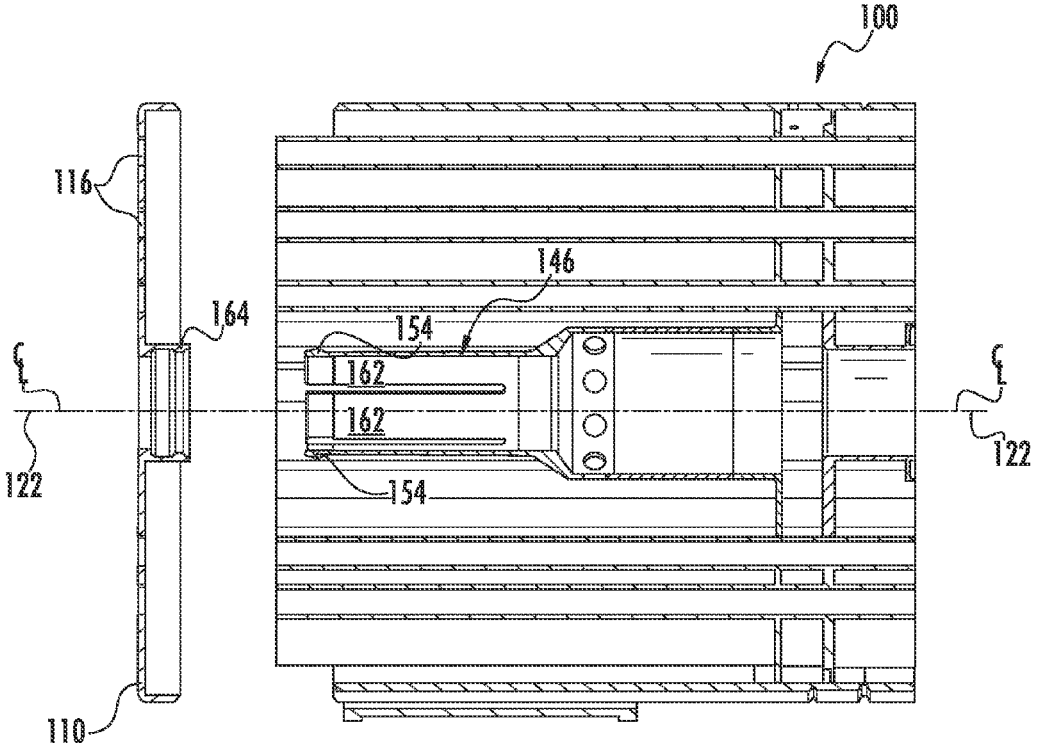
FIG. 6 is a partially exploded cross section view of a portion of the fuel injector including the aft plate, according to one embodiment of the present invention.

FIG. 6 provides a partially exploded cross section view of a portion of the fuel injector 100 including the aft plate 110, according to one embodiment of the present invention. As shown, the aft plate 110 includes a retention collar 164. In particular embodiments, the retention collar 164 is coaxially aligned with the retention sleeve 146. The retention collar 164 and the air sleeve 150 at least partially define the cartridge passage 130.

Figure 7:
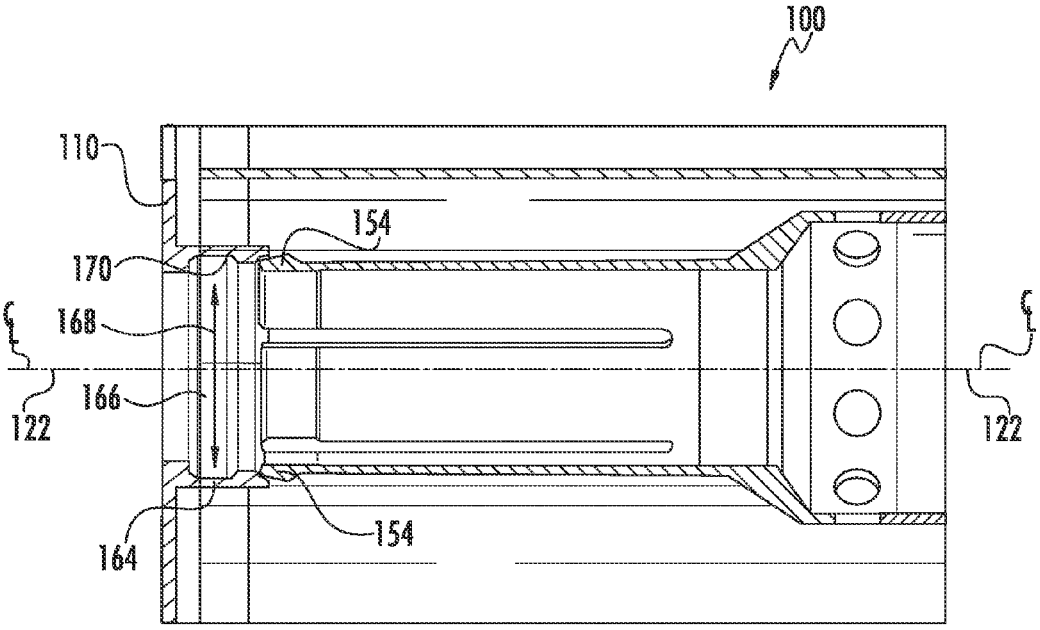
FIG. 7 is an enlarged cross sectional view of the fuel injector including an exemplary retention sleeve and an exemplary aft plate, according to one embodiment of the present invention.
Figure 8:
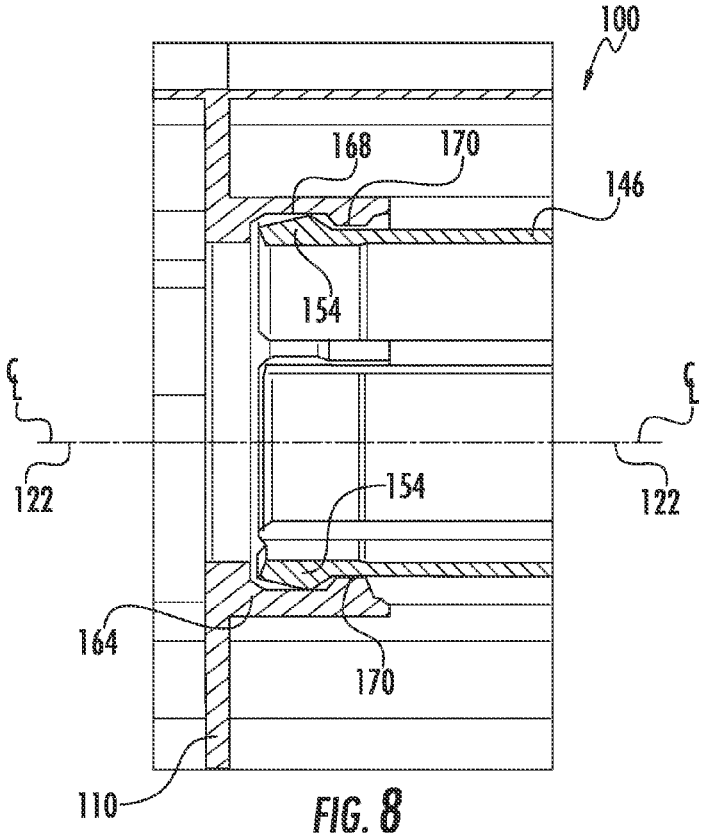
FIG. 8 is an enlarged cross sectional view of the fuel injector including an exemplary retention sleeve and an exemplary aft plate, according to one embodiment of the present invention

FIGS. 7 and 8 are enlarged cross sectional views of the fuel injector 100 including the retention sleeve 146 and the aft plate 110 according to one embodiment of the present invention. In one embodiment, as shown in FIGS. 7 and 8, the retention collar 164 is configured to receive and/or engage with the retention features 154 of the retention sleeve 146. For example, an inner surface 166 of the retention collar 164 may define and/or include an engagement feature 168 such as a slot, groove or undercut that extends at least partially circumferentially along the inner surface 166. The engagement feature 168 may define an axial stop feature 170 such as a ledge.

As shown in FIG. 8, the engagement feature 168 may have a profile that is complementary to a profile of the retention features 154. In one embodiment, the retention features 154 are seated into the engagement feature 168. In this manner, the retention sleeve 146 locks or retains the aft plate 110 to the fuel injector 100. The retention features 154 may be held in position by the radial spring force exerted by the spring arms 162.

Figure 9:
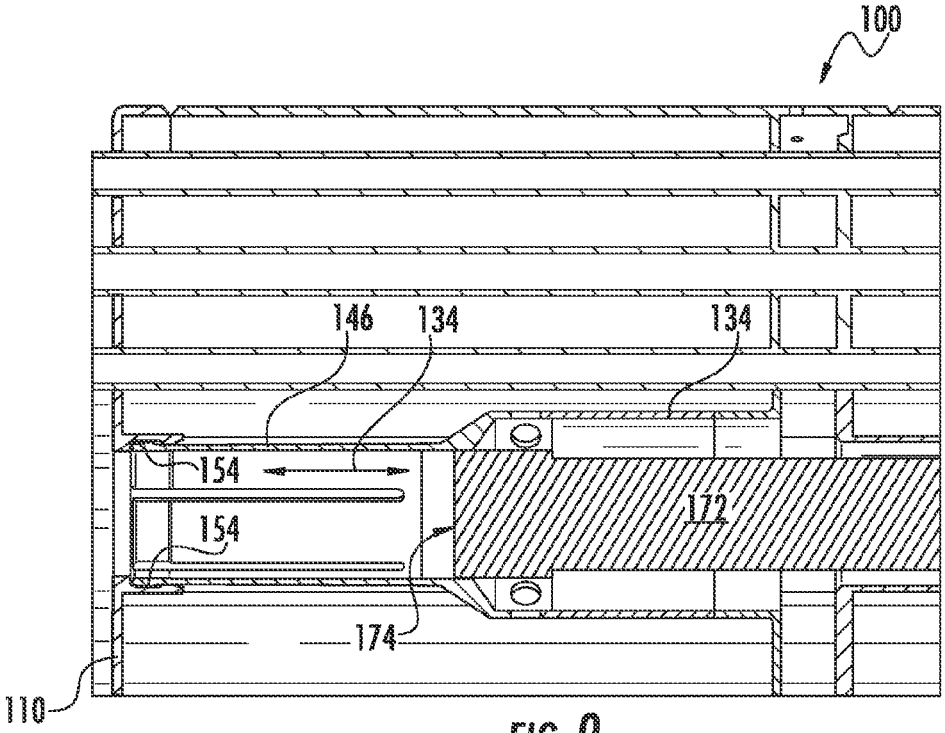
FIG. 9 is an enlarged cross sectional view of the fuel injector as shown in FIG. 7 including an exemplary cartridge, according to one embodiment of the present invention.
Figure 10:
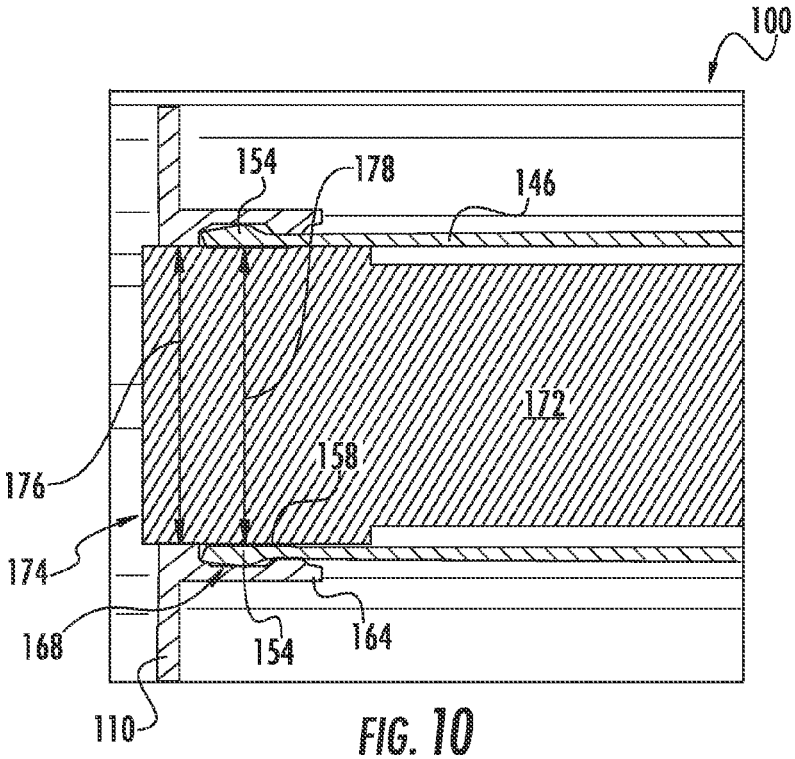
FIG. 10 is an enlarged cross sectional view of the fuel injector as shown in FIG. 9, according to one embodiment of the present invention.

FIGS. 9 and 10 are enlarged cross sectional views of the fuel injector 100 including the retention sleeve 146 and the aft plate 110 according to one embodiment of the present invention. In one embodiment, as shown in FIGS. 9 and 10, the fuel injector 100 includes a cartridge 172. In particular embodiment, the cartridge 172 may comprise a fuel cartridge, an air cartridge or a blank cartridge. The cartridge 172 includes a downstream or aft end 174.

During installation, as shown in FIG. 9, the cartridge 172 is inserted generally axially through the cartridge passage 134. As shown in FIG. 10, the downstream end 174 of the cartridge 172 is inserted and/or disposed within the retention sleeve 146. In one embodiment, the cartridge 172, particularly the downstream end 174 is configured to engage with the inner surface 158 of the retention sleeve 146 proximate to the retention features 154, thereby locking the retention features 154 into the engagement feature 168 of the retention collar 164. For example, in one embodiment the downstream end 174 of the cartridge 172 may have an outer diameter 176 that is the same or greater than an inner diameter 178 of the retention sleeve 146, thereby exerting a radially outward force to the retention features 154.

The various embodiments provided herein, provide various technical advantages over existing bundled tube fuel injector assemblies. For example, the lack of a weld joint between the aft plate 110 and the retention sleeve 146 reduces assembly time and costs. In addition, the lack of a weld joint between the aft plate 110 and the retention sleeve 146 decreases cost to repair and/or inspect by decreasing or eliminating secondary machining operations currently required to break a weld joint and to prepare the components for reassembly. In addition, the retention features provide a reliable retention system for the aft plate, thus increasing the overall reliability of the fuel injector 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A bundled tube fuel injector, comprising:

a fuel distribution module;

a tube bundle having a plurality of pre-mix tubes that extend in parallel through and downstream from the fuel distribution module;

a support plate disposed substantially adjacent to and downstream from the fuel distribution module, the plurality of pre-mix tubes extending through the support plate;

a retention sleeve circumferentially surrounded by the plurality of premix tubes, wherein the retention sleeve includes a first end coupled to the support plate and a second end defining a plurality of spring arms, each spring arm including a respective radially extending retention feature; and an aft plate, the aft plate having a retention collar formed to interlock with each of the retention features, wherein the retention sleeve and the retention collar partially define a cartridge passage that extends through the bundled tube fuel injector.

2. The bundled tube fuel injector as in claim 1, further comprising a cartridge that extends through the cartridge passage within the retention sleeve, the cartridge having a downstream end configured to engage with the retention features.

3. The bundled tube fuel injector as in claim 1, wherein the retention features are at least partially defined by the retention sleeve.

4. The bundled tube fuel injector as in claim 1, wherein a portion of each retention feature extends radially outwardly with respect to an outer surface of the retention sleeve.

5. The bundled tube fuel injector as in claim 1, wherein a portion of each retention feature extends radially inwardly with respect to an inner surface of the retention sleeve.

6. The bundled tube fuel injector as in claim 1, wherein the retention sleeve is coupled to the support plate via an air sleeve.

7. The bundled tube fuel injector as in claim 1, wherein the retention sleeve is slotted from the second end towards the first end.

8. A bundled tube fuel injector, comprising:

a fuel distribution module;

a fluid conduit in fluid communication with the fuel distribution module, wherein the fluid conduit partially defines a cartridge passage through the fuel distribution module;

a tube bundle having a plurality of pre-mix tubes that extend in parallel through and downstream from the fuel distribution module;

a retention sleeve coaxially aligned with an inner sleeve of the fluid conduit and circumferentially surrounded by the pre-mix tubes, the retention sleeve having a first end proximate to the fuel distribution module and a second end distal from the fuel distribution module, the second end defining a plurality of spring arms, each spring arm including a respective radially extending retention feature; and an aft plate, the aft plate having a retention collar aligned with the retention sleeve and formed to interlock with the retention features.

9. The bundled tube fuel injector as in claim 8, further comprising a cartridge that extends axially through the cartridge passage and through the retention sleeve towards the retention collar, the cartridge having a downstream end disposed within the retention sleeve and configured to exert a radially outward force to the retention features.

10. The bundled tube fuel injector as in claim 8, wherein the retention features are at least partially defined by the retention sleeve.

11. The bundled tube fuel injector as in claim 8, wherein a portion of each retention feature extends radially outwardly with respect to an outer surface of the retention sleeve.

12. The bundled tube fuel injector as in claim 8, wherein a portion of each retention feature extends radially inwardly with respect to an inner surface of the retention sleeve.

13. The bundled tube fuel injector as in claim 8, further comprising a support plate disposed substantially adjacent to the fuel distribution module, the plurality of tubes extending axially through the support plate, wherein the first end of the retention sleeve is coupled to the support plate.

14. The bundled tube fuel injector as in claim 8, wherein the retention sleeve is slotted from the second end towards the first end.

15. A gas turbine, comprising:

a compressor;

a combustor downstream from the compressor;

a turbine disposed downstream from the combustor; and wherein the combustor includes an end cover coupled to an outer casing and a bundled tube fuel injector that extends downstream from the end cover, the bundled tube fuel injector comprising:

a fuel distribution module;

a fluid conduit in fluid communication with the end cover and the fuel distribution module, the fluid conduit comprising an inner sleeve, wherein the inner sleeve defines a cartridge passage through the fuel distribution module;

a tube bundle having a plurality of pre-mix tubes that extend in parallel through and downstream from the fuel distribution module;

a retention sleeve coaxially aligned with the inner sleeve, the retention sleeve having a first end proximate to the fuel distribution module and a second end distal from the fuel distribution module, the second end defining a plurality of spring arms, each spring arm including a respective radially extending retention feature; and an aft plate that extends radially and circumferentially across an end portion of the bundled tube fuel injector, the aft plate having a retention collar coaxially aligned with the retention sleeve and formed to interlock with the retention features.

16. The gas turbine as in claim 15, further comprising a cartridge that extends within the retention sleeve, the cartridge having a downstream end disposed within the retention sleeve, wherein the downstream end is configured to engage with the retention features.

17. The gas turbine as in claim 15, wherein a portion of each retention feature extends radially outwardly with respect to an outer surface of the retention sleeve and wherein a portion of each retention feature extends radially inwardly with respect to an inner surface of the retention sleeve.

18. The gas turbine as in claim 15, wherein the retention sleeve is slotted from the second end towards the first end.

* * * * *